US007036630B2

(12) United States Patent
Korchagin et al.

(10) Patent No.: US 7,036,630 B2
(45) Date of Patent: May 2, 2006

(54) HIGH-RISE, FIRE-FIGHTING, RESCUE AND CONSTRUCTION EQUIPMENT

(75) Inventors: Pavel V. Korchagin, Apt. 81, House 30, Building 1, Beskudnikovsky Boulevard, Moscow (RU) 127474; Marina E. Korchagina, Apt. 112, House 5, Second Khoroshevkiy Lane, Moscow (RU) 123007; Vladimir I. Maloletkov, Samara (RU); Igor I. Goldstein, 16776-39th Ave. N., Plymouth, MN (US) 55446

(73) Assignees: Pavel V. Korchagin, Moscow (RU); Marina E. Korchagina, Moscow (RU); Vladimir I. Yudakov, Samara (RU); Igor I. Goldstein, Plymouth, MN (US); Andrey G. Tirskiy, Moscow (RU)

( * ) Notice: Subject to any disclaimer, the term of this patent is extended or adjusted under 35 U.S.C. 154(b) by 71 days.

(21) Appl. No.: 10/334,023

(22) Filed: Dec. 30, 2002

(65) Prior Publication Data

US 2005/0023082 A1 Feb. 3, 2005

Related U.S. Application Data

(63) Continuation-in-part of application No. 10/205,981, filed on Jul. 26, 2002.

(51) Int. Cl.
*B66B 9/00* (2006.01)

(52) U.S. Cl. ..... 182/82

(58) Field of Classification Search ..... 182/82; 187/239; 104/127, 106

See application file for complete search history.

(56) References Cited

U.S. PATENT DOCUMENTS

| | | | | |
|---|---|---|---|---|
| 394,781 | A * | 12/1888 | Maurer | 182/229 |
| 4,023,503 | A * | 5/1977 | Grop | 105/30 |
| 4,406,349 | A * | 9/1983 | Vilchek | 182/7 |
| 4,499,966 | A * | 2/1985 | Milne et al. | 182/3 |
| 4,830,141 | A * | 5/1989 | Montaigne | 182/82 |
| 4,865,155 | A * | 9/1989 | Montaigne et al. | 182/14 |
| 5,533,670 | A * | 7/1996 | Chen | 238/187 |
| 2004/0086333 | A1 * | 5/2004 | Swartz | 404/1 |

FOREIGN PATENT DOCUMENTS

DE 3939762 A1 * 6/1991

* cited by examiner

*Primary Examiner*—Alvin Chin-Shue
(74) *Attorney, Agent, or Firm*—Nikolai & Mersereau, P.A.

(57) ABSTRACT

An elevator system for traveling on a rail attached to the outside of a high-rise building. The rail has an H shape and has trolleys connected to cables riding in a channel on the rail for raising and lowering elevators. Motors rotate spoils having cables connected to the trolleys. One elevator having a telescoping arm attached for reaching any position on or above the building. A platform or cabin attached to the telescoping arm can deliver materials to the building while under construction and thereafter be used for building maintenance such as window washing. The movable platform adjacent a building can take the place of scaffolding for a safer work environment. The telescoping arm may have various attachments for different functions such as for rescuing people trapped in a high-rise during a fire or for positioning fire fighters and hoses or fire fighting equipment next to a fire.

8 Claims, 9 Drawing Sheets

HIGH-RISE, FIRE-FIGHTING, RESCUE AND CONSTRUCTION EQUIPMENT

BACKGROUND OF THE INVENTION

1. Field of the Invention

This invention relates generally to an elevator system running on a rail attached to the outside of a building. The rail can support two cables for lifting or lowering two elevators. The elevator system may have two cars, a combination elevator and crane and an elevator. The invention can be used for fire fighting and rescue and can also be used for construction and maintenance of high-rise structures.

2. Description of the Related Art

Currently vertical transportation in high-rise structures is limited to stairs and elevators. Fire fighters on the outside of the building are limited by how high their ladders will reach when fighting fires or attempting rescues. Construction and building maintenance is limited as to access to the outside walls and roof of the building. For example window washing is limited to a plank or precariously dangling from ropes extending from the top of a building. Construction of the building is similarly hampered by the need for scaffolding and lack of easy transportation and access to all areas on the outside of a high-rise building.

SUMMARY OF THE INVENTION

The invention utilizes an elevator having a crane portion. The elevator portion is for traveling vertically up and down the outside of a building. The crane portion extends form the elevator portion to a desired location on the building. The crane portion can support a passenger cabin for fire rescue. The cabin can also have fire-fighting equipment for access to all portions of a building. The crane can also haul building materials to any location on a building under construction and can be used for window washing or other maintenance activities on the outside of the building.

The crane portion has a telescoping arm for adjusting the distance between the cabin and the elevator. The telescoping arm has pivots on both ends. One pivot is attached to the cabin for keeping the floor of the cabin horizontal. The second pivot is to angularly position the telescoping arm relative the elevator portion. A rotating portion on the elevator portion swings the telescoping arm toward or away from the building.

The invention also utilizes a second elevator. Both elevators run vertically on an H shaped rail attached to the side of a building. The rail has a channel for running two separate cables connected to two separate trolleys riding in the channel for lifting and lowering the elevators on the rail. The rail is engaged by wheels on the elevators to stabilize the elevator. The wheels can be mounted on arms that pivot and temporarily clamp the elevator to the rail permitting the elevator to engage the rail or the elevator wheels can permanently engage the rail. The pivoting arms can be opened to remove the elevator from the rail so that the elevator can be transported to a different rail on the same building or to a rail on another building.

OBJECTS OF THE INVENTION

It is an object of the invention to provide vertical and horizontal transportation to the outside surface or roof of a building.

It is an object of the invention to transport fire-fighting equipment at any point on the outside of a building.

It is an object of the invention to rescue people from buildings during fires or other emergencies.

It is an object of the invention to transport construction materials to any part of a building under construction.

It is an object of the invention to provide a platform for construction or maintenance personnel for working on a building.

It is an object of the invention to provide a transportable fire fighting and rescue system to high-rise structures.

Other objects, advantages and novel features of the present invention will become apparent from the following description of the preferred embodiments when considered in conjunction with the accompanying drawings.

DESCRIPTION OF THE PREFERRED EMBODIMENTS

High-rise buildings are hazardous during fires since fire-fighting equipment is limited to reaching only the lower floors because ladders, cherry pickers and other equipment have limits of extension well short of the upper floors. A further hazard is that inside elevators cannot be used during a fire since people could become trapped inside the elevators or be exposed to smoke. It therefore becomes difficult to evacuate a high-rise building during a fire, to rescue people trapped inside or to fight the fire.

Further, it is useful to have equipment on the building for access to the outside surface for window washing and maintenance. The equipment can also be used during construction to haul materials and workmen to the positions on the outside of the building or to access the upper floors and roof during construction.

The invention provides a vertical column or rail 17 attached to the outside surface of a building 18 and an elevator car or elevator cars 3 and 58 attached to the rail 17 for riding up and down the outside of the building 18.

Figure 1:
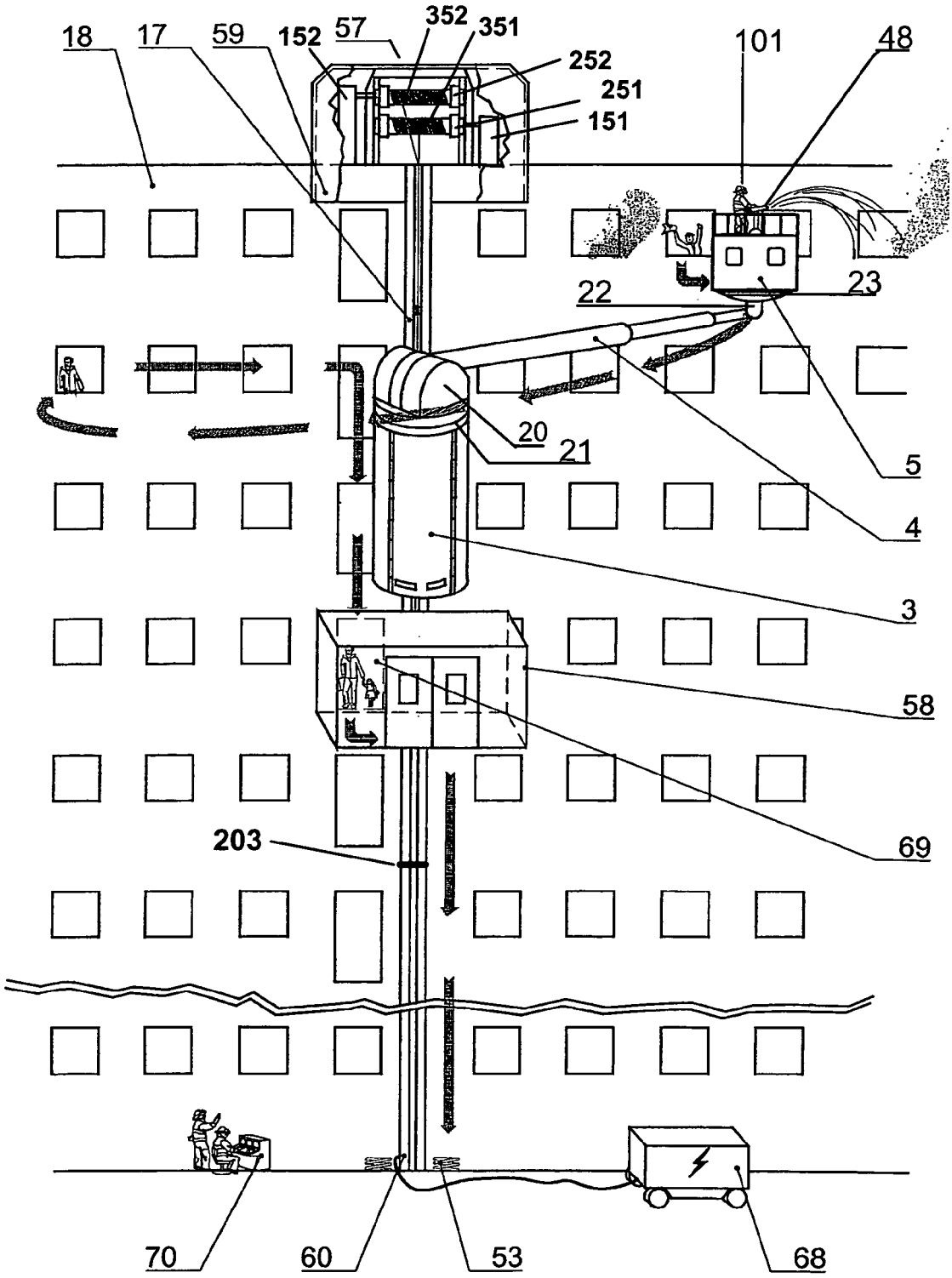
FIG. 1 shows a front view of the invention on a building.

As shown in FIG. 1 building 18 has a housing 59 on the roof containing lifting mechanism 57, which comprises motors 151 and 152 for driving two separate spools 251 and 252 respectively, having two separate cables 351 and 352 respectively, for lifting or lowering the elevator cars 3 or 58.

Elevator 58 is stored in housing 59 until it is needed. It is aligned with emergency exits 69 on the outside of building 18 for evacuating people during emergencies such as a fire.

Shock absorbing elements 53 at the base of column 17 help provide a smooth stop for elevator car 58 at the base of building 18.

An auxiliary power supply 68 can be used to supply power to the motors 151 and 152 to power the elevators 3 and 58 in case of a power outage in the building 18. The power supply 68 plugs into the column 17 at electrical connector 60.

The controls for elevators 3 and 58 can be in the elevators or remotely controlled from ground at control station 70.

Elevator 3 has a crane portion attached on the top. The crane portion comprises a pivoting mechanism 20, a turning mechanism 21, a telescoping arm 4, a pivoting mechanism 22, and a cabin 5. The cabin 5 can support fire fighting equipment 48 and firemen 101. The cabin 5 can be rotated on turning mechanism 23. The crane portion can position the cabin 5 at any desired position along the face of the building 18 by a combination of the elevator 3 moving up or down, and the crane portion using the pivoting mechanism 20 to swing the telescoping arm 4 to the desired angle and then extending or retracting to a desired position adjacent building 18. The turning mechanism 21 can move the cabin 5 toward or away from the building 18. The cabin 5 can be used to rescue people who cannot get to the emergency exits 69.

The vertical column 17 can be attached to a building 18 as the building is being constructed or it can be added to an existing building. The vertical column 17 can have expansion joints 103 between sections of r rail 17. The expansion joints 103 are made out of an alloy or material which is fireproof and has a low coefficient of expansion with temperature.

Figure 2:
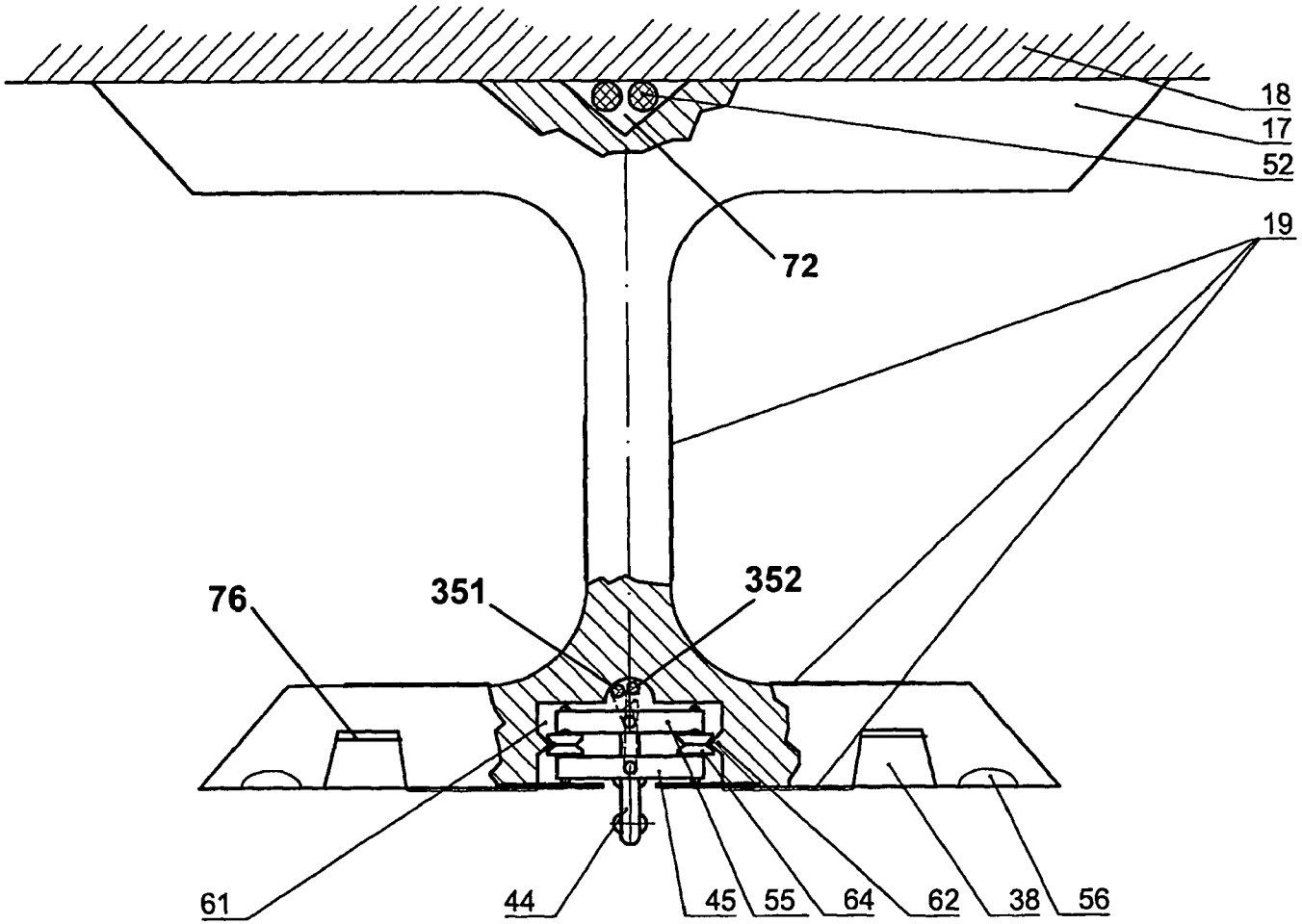
FIG. 2 shows a top cross section of the elevator column.

As FIG. 2 shows, vertical column or rail 17 has an H shape and has several features designed for use with the elevators 3, 58. The vertical column 17 has a high friction coating 19 to make a better contact with tires 9 on the elevators 3 and 58. A power cable channel 72 in the H shaped vertical column 17 allows electrical power cables 52 to access the roof to drive motors 151 and 152. Guides 38 on the outside face of vertical column 17 allow for wheels 9 or cog wheels 36 on the elevators 3 and 58 to engage the vertical column 17 and keep the elevators 3, 58 aligned on the column 17. Lights 56 may also be installed on the vertical column 17 to help during nighttime operations.

The H shaped vertical column 17 also has a trolley channel 61 for cables 251 and 252 to travel in. The trolley cables 251 and 252 are connected to trolleys 45 and 55, which run separately in trolley channel 61. Trolley 45 is attached to elevator car 3 and trolley 55 is attached to elevator car 58. Trolley wheels 64 engage the trolley guides 62 in the trolley channel 61.

Figure 3:
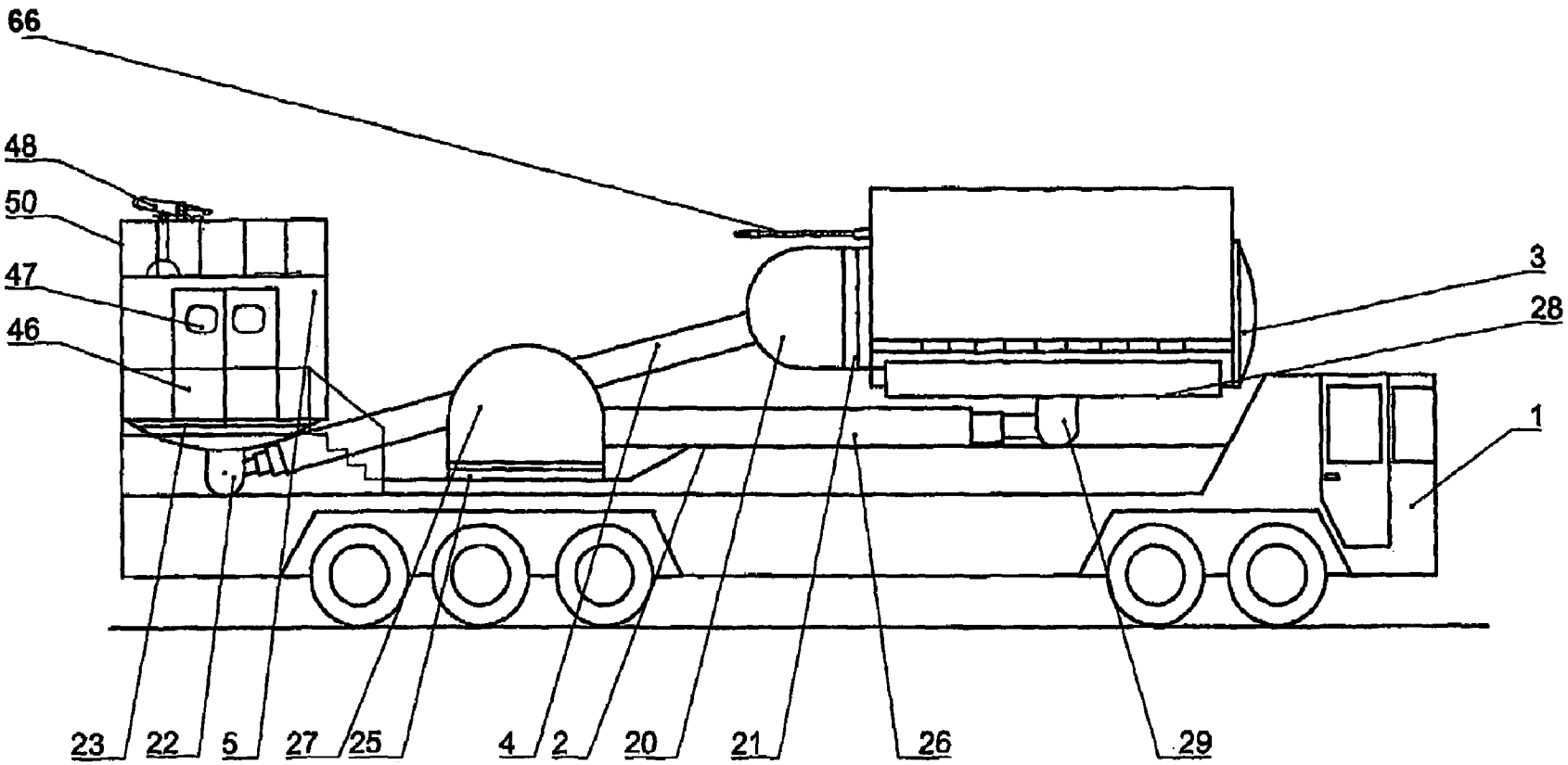
FIG. 3 shows a side view of the elevator with crane on a transport vehicle.

As shown in FIG. 3 the elevator 3 and the crane portion are transportable to building 18 by a truck 1. If the elevator 3 is for fire fighting the truck 1 may be a specialized fire truck. If the elevator is used during construction or maintenance the truck may be a construction truck. When truck 1 arrives at building 18 the elevator 3 is attached to the rail 17. When finished with its work, elevator 3 can be removed from the rail 17 and used on another portion of the same building or moved to a different building.

Figure 4:
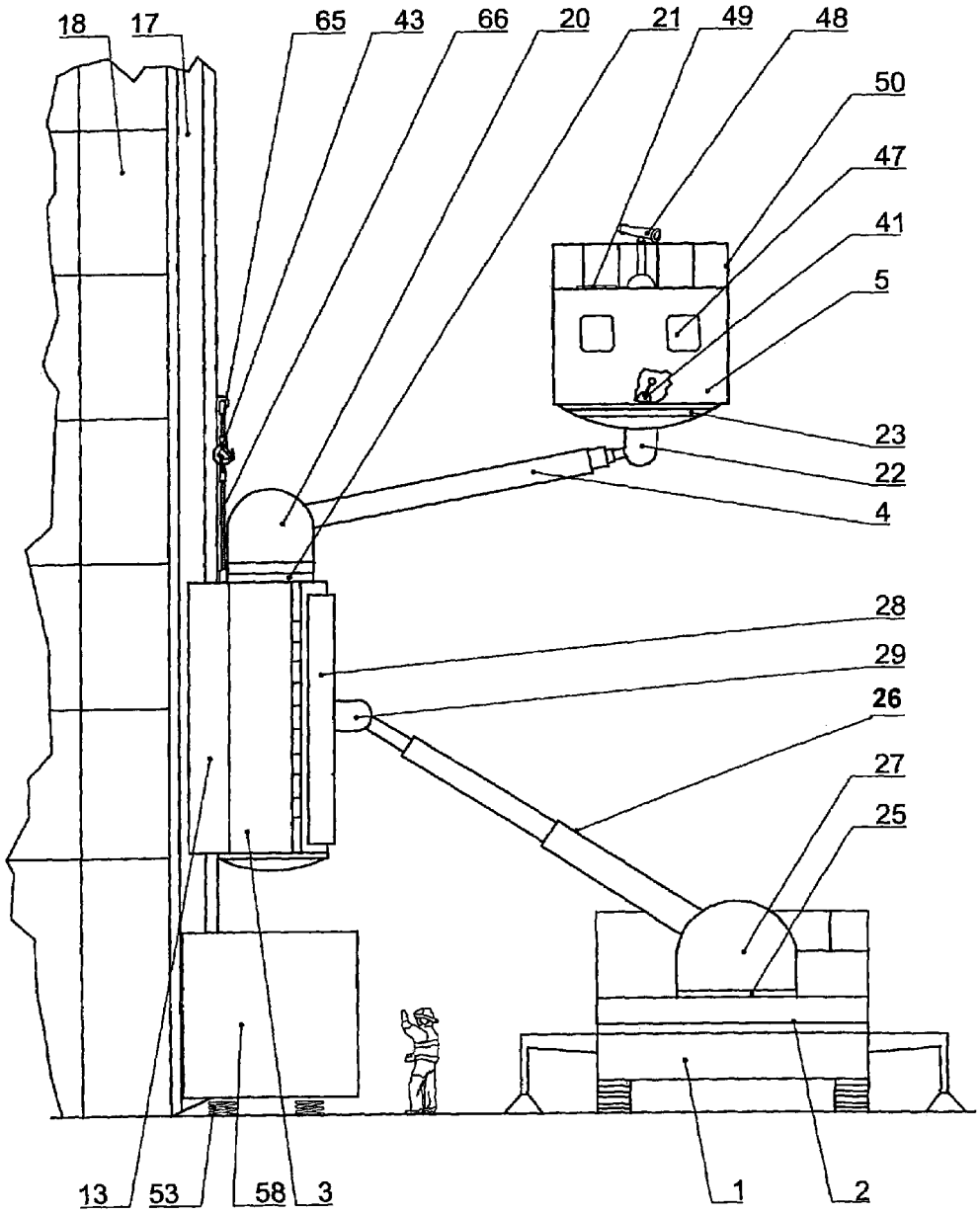
FIG. 4 shows a side view of the elevator with crane being installed on a rail.

FIG. 4 shows elevator 3 being installed on vertical column 17. Truck 1 is adjacent the building 18. The top surface 2 of the truck 1 has a rotating mechanism 25 for turning pivoting mechanism 27 which has a telescoping arm 26 attached. Telescoping arm 26 is connected to pivoting mechanism 29, which is connected to holding mechanism 28 for holding elevator 3 in position for connecting it to vertical column 17.

Figure 9:
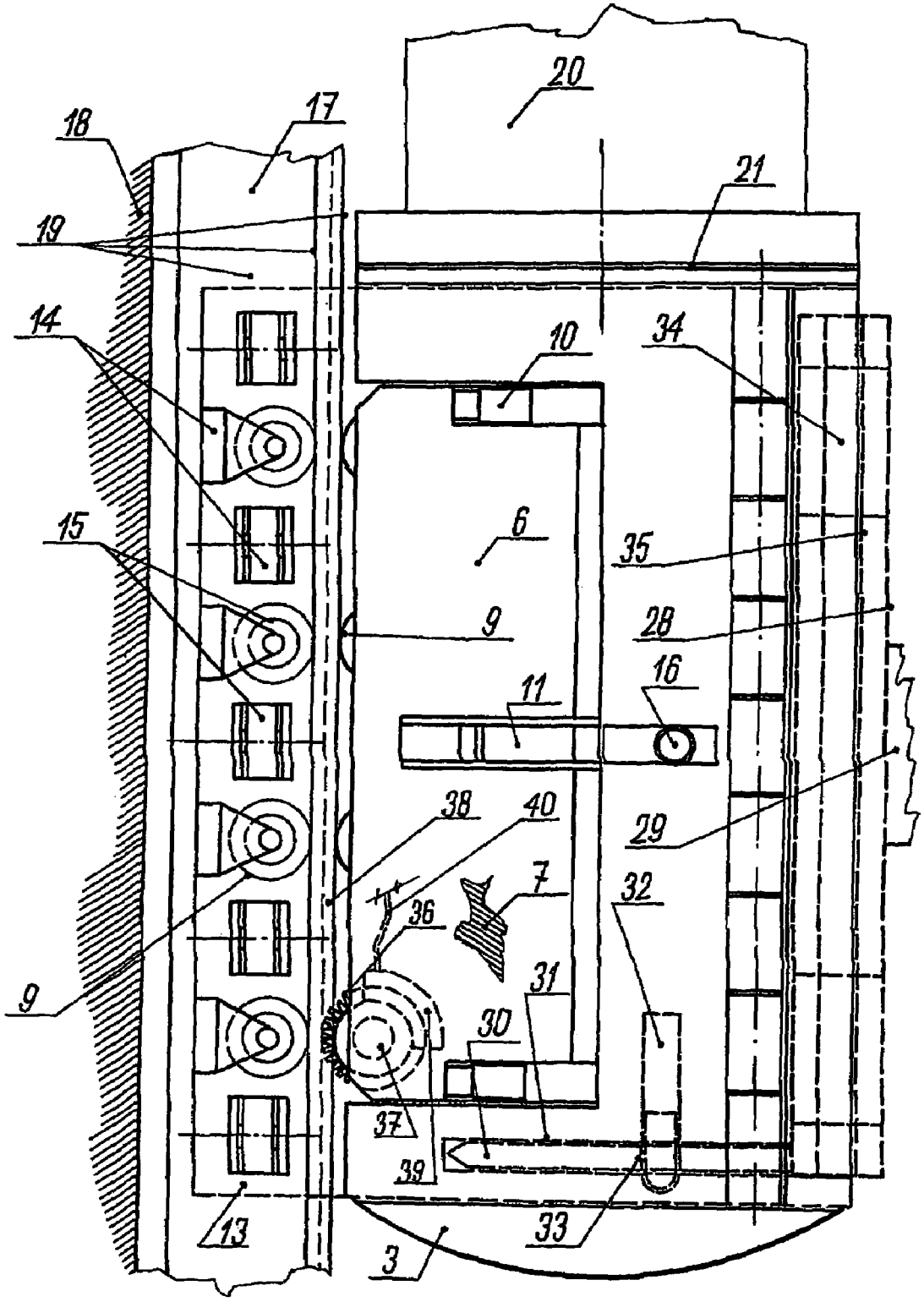
FIG. 9 is a side cross sectional view of the elevator with crane on the rail.

FIG. 9 shows how the elevator 3 is lifted into place by holding mechanism 28. Forklift tines 30 are inserted into a portion of the elevator 3. The fork lift tines 30 have apertures 33 which are engaged by jack elements 32 to lock the elevator 3 onto the fork lift tines while the elevator 3 is being positioned by against rail 17. A stabilizing slot 35 on elevator 3 helps hold the elevator 3 in position on holding mechanism 28, which fits into the slot. Optionally electromagnets 34 can be used to either hold the elevator in position relative to the holding mechanism 28 or act in conjunction with the fork tines 30 to hold the elevator 3 in place.

Figure 5:
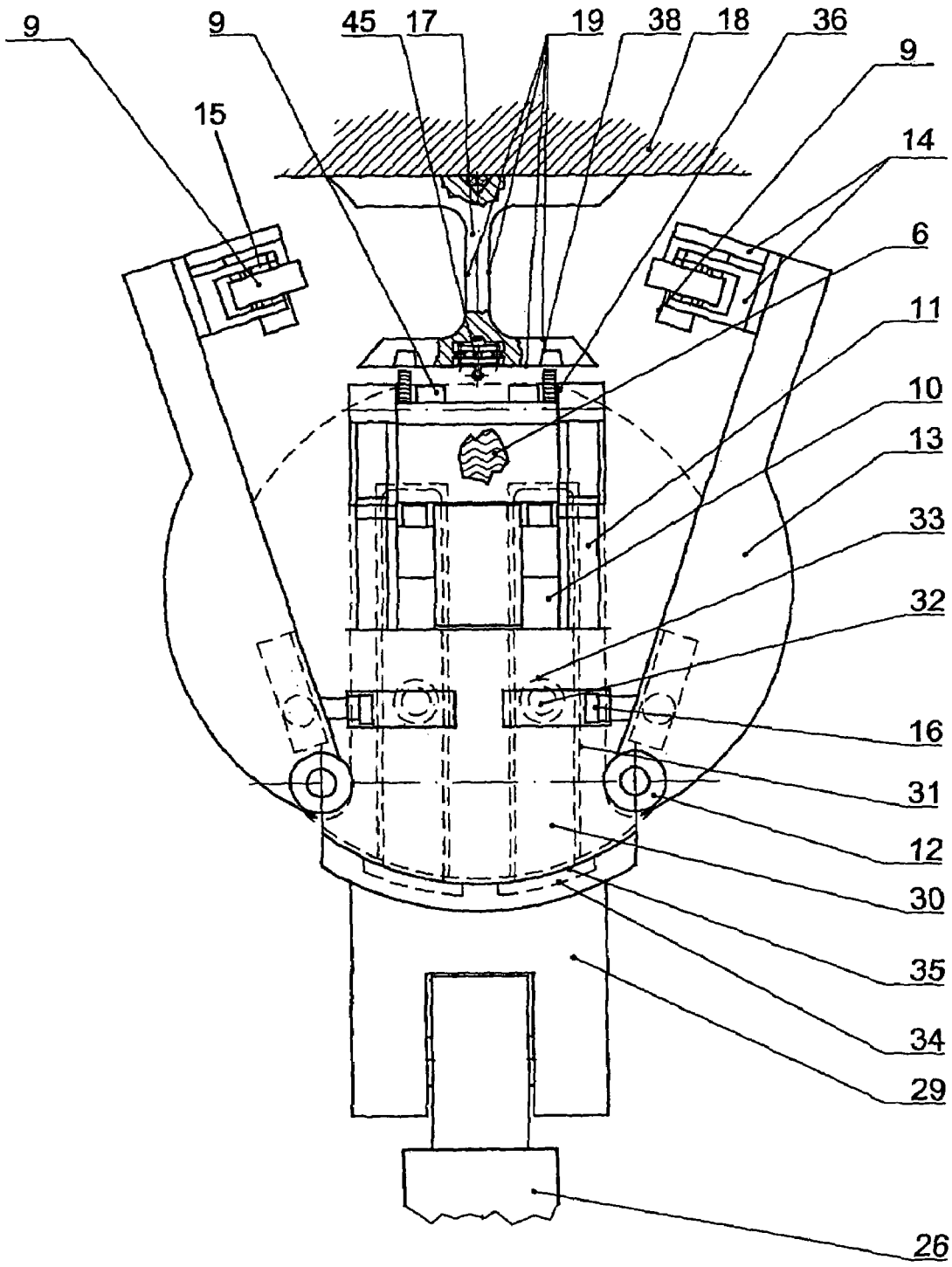
FIG. 5 shows a top view of the elevator with the arms open and wheels disengaged from the rail.
Figure 6:
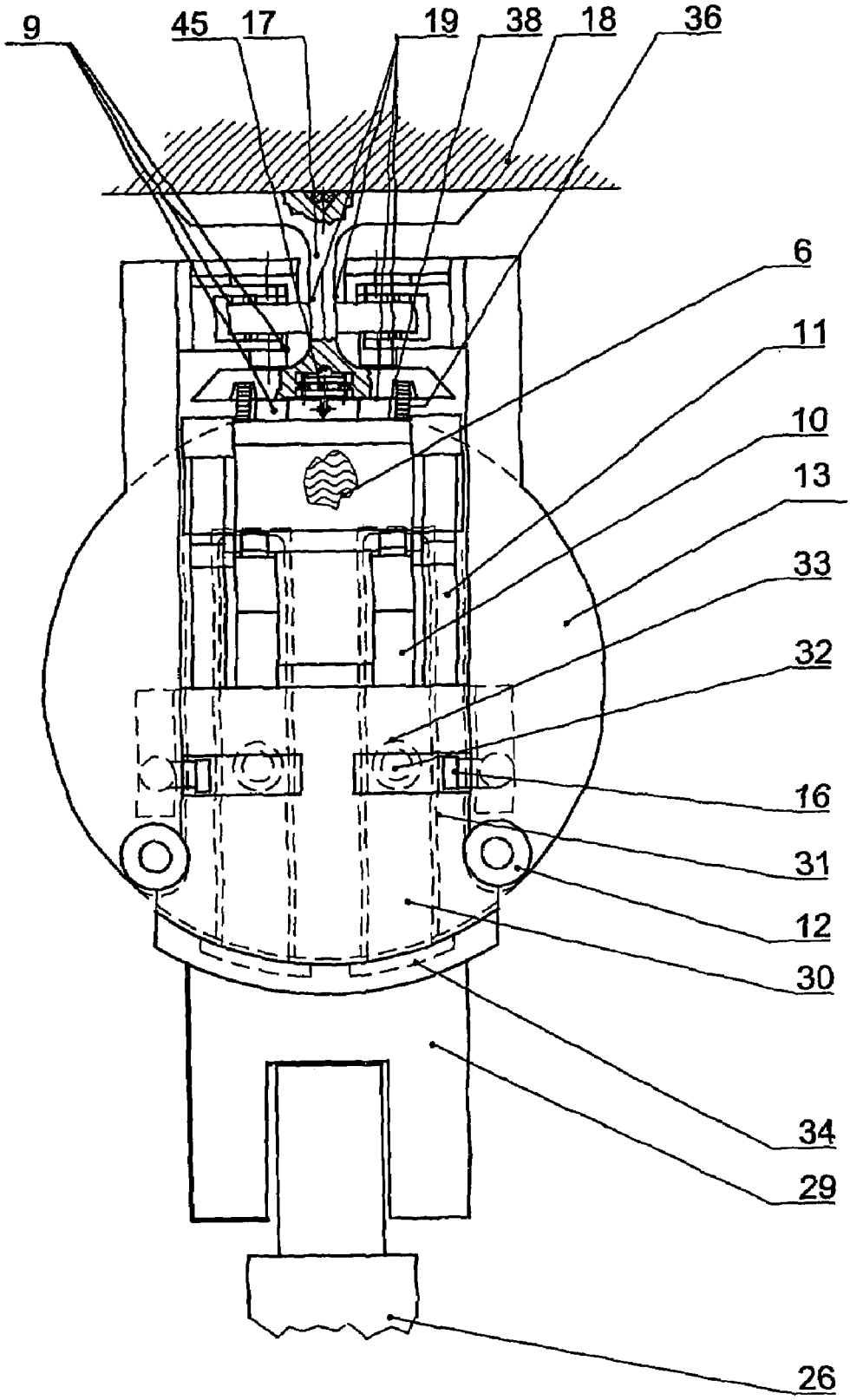
FIG. 6 shows a top view of the elevator with the arms closed and wheels engaging the rail.
Figure 7:
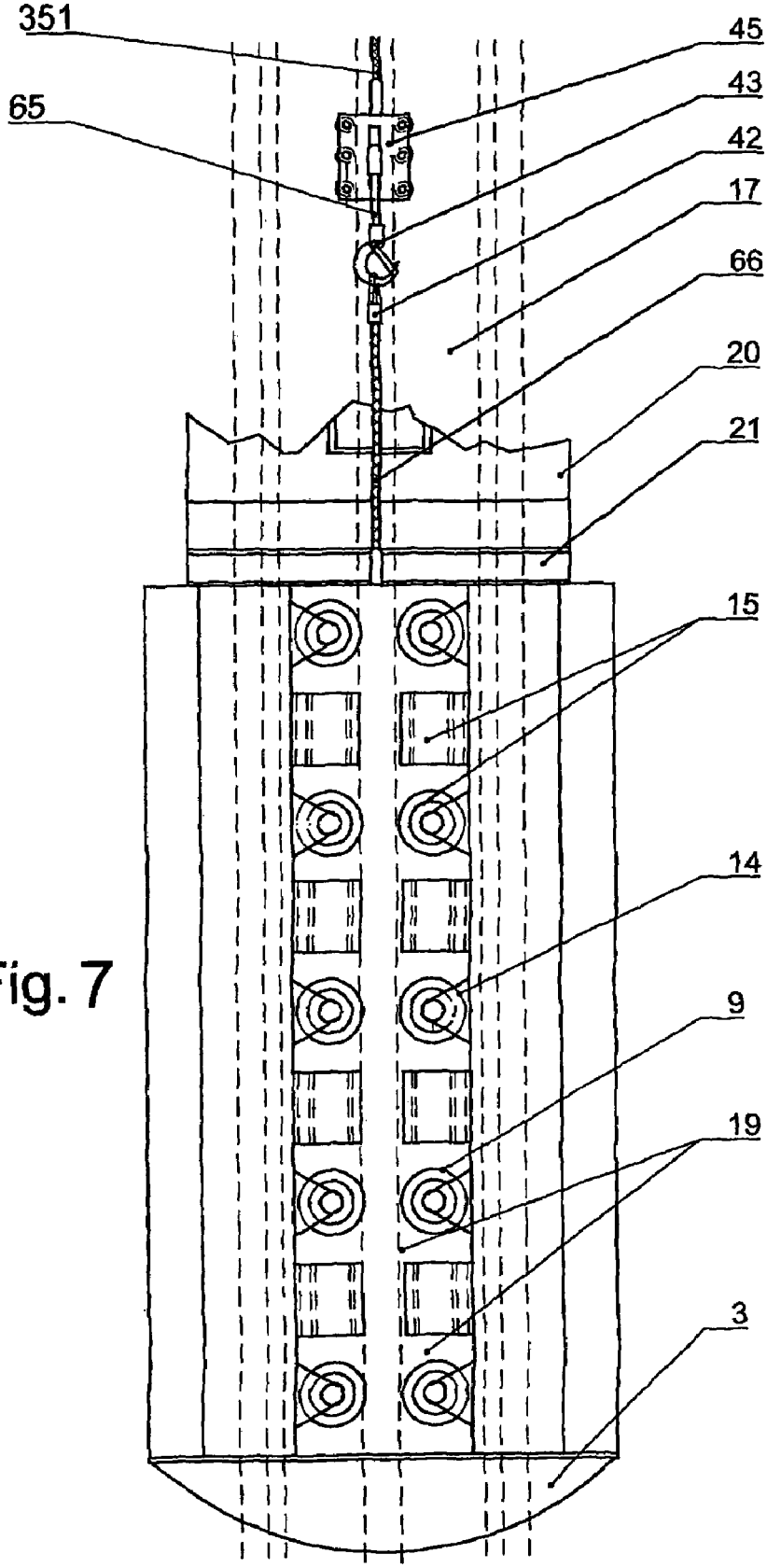
FIG. 7 is a front cross sectional view of an elevator connected to a trolley.

As shown in FIGS. 5 and 6 the H shaped column 17 is engaged by elastic tires 9 on wheels 15, prevent left to right movement on the rail 17 relative to the building 18. The wheels 15 are supported on frames 14 attached to spreadable arms 13. The arms 13 pivot on hinge 12 and are opened or closed by operating pistons 16. When arms 13 are opened the elevator portion 3 can be removed from the H shaped rail 17. When the arms 13 are clamped closed on the H shaped rail 17 the elevator portion 3 is attached to the rail 17.

With the elevator portion 3 attached to the rail 17 additional wheels 15 having tires 9 on the spread arms 13 rotated 90 degrees to the first set of wheels 15 have tires 9 to engage the inside surface of the top of the H shaped rail 17. Additional wheels 15 with tires 9 engage the outside surface of the top of the H shaped rail 17. The wheels 15 on the inside and outside of the top of the H shaped rail 17 are pressed together by a jack device 11 engaging telescoping beam 10 to push tires 9 against rail 17

Guides 38 indented in the columns 17 engage wheels such as cogwheels 36, which engage apertures or racks 76 in the columns 17 to grippingly engage the column 17. A brake having break calipers 39 operating on disc 37 attached to cog wheel 36 (FIG. 9) can be used by operating brake lever 41 attached to brake cable 40 for stopping the elevator portion 3 in emergencies by pulling on emergency break 41 in cabin 5 on elevator 3 or in elevator 58.

With elevator 3 held in place on column 17 it can be connected to trolley 45 by a cable 66 having an eye connector 42 on the end of the cable and placed on hook 43, which is attached by a cable 65 to the trolley 45.

Figure 8:
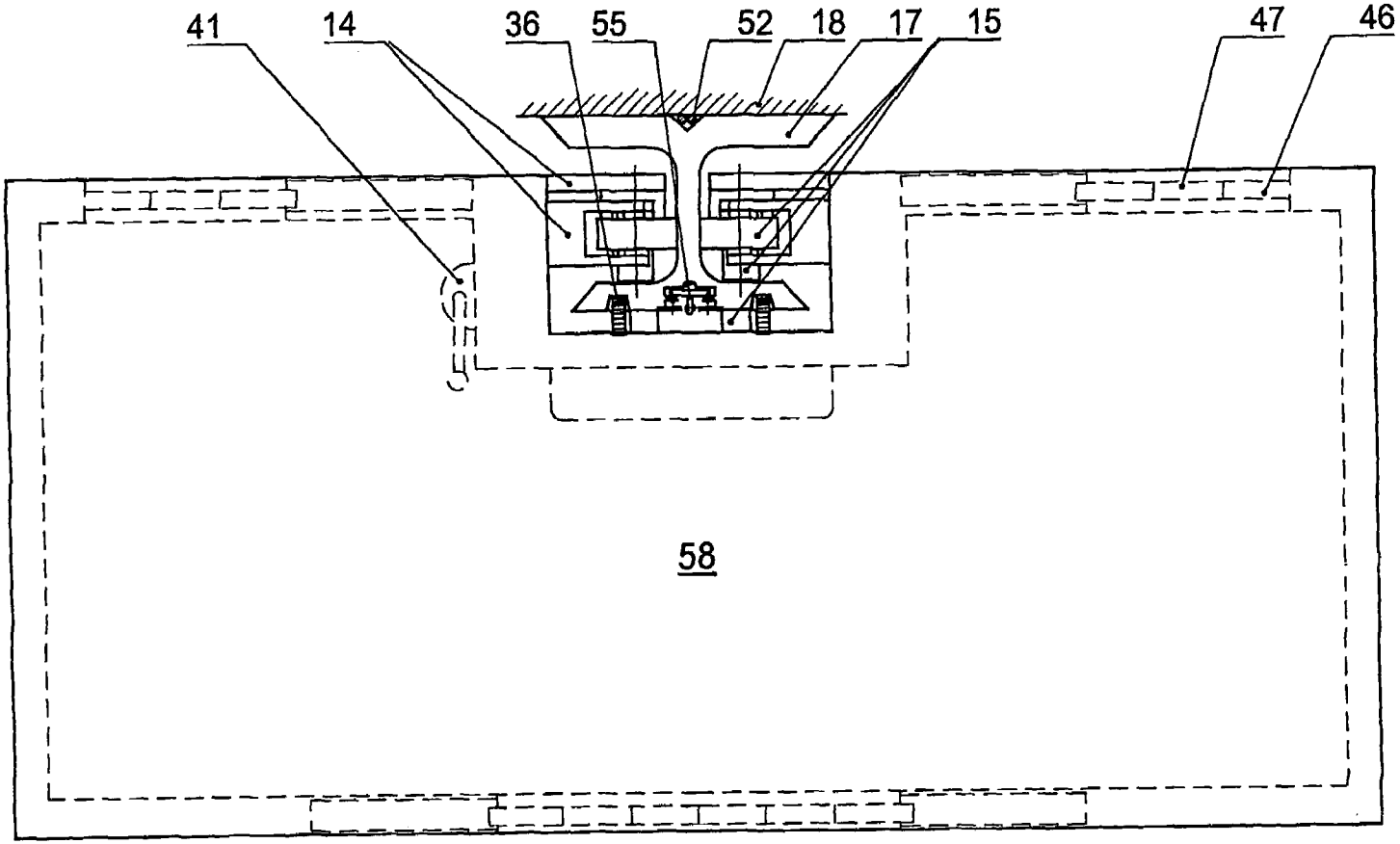
FIG. 8 shows a top cross sectional view of an elevator on the H shaped rail.

Elevator 58 as shown in FIG. 8 is attached to column 17 in a similar manner as elevator 3, the difference being that elevator 58 is permanently connected to the column 17. Therefore wheel frame 14 is permanently in place for holding the tires 9 on wheels 15 against column 17.

In some embodiments the cogwheels 36 can be used as the drive wheels. An engine compartment 7, in FIG. 9, has an engine or electric motor for providing power to drive wheels 36 for propelling the elevator portion 3 along column 17. The engine compartment 7 in this embodiment replaces a portion of the storage tank 6 for fire fighting foam in the elevator 3 since cable 45 lifts and lowers the elevator 3.

In all the embodiments the elevator 58 or cabin 3 can carry passengers. The elevators can have fireproof doors 46 and fireproof windows 47 and walls.

Elevator 58 can be directly connected to trolley 55 without intervening cables since it is permanently connected to rail 17.

Cabin 5 has an access hatch 49 for climbing out of the cabin 5 to the top of the cabin which has a flat roof for standing on and a railing 50. Fire fighting equipment 48 such as a nozzle can be used to spray water, foam or chemicals on a fire.

FIG. 1 shows expansion joint 203 in rail 17.

Obviously, many modifications and variations of the present invention are possible in light of the above teachings. It is therefore to be understood that, within the scope of the appended claims, the invention may be practiced otherwise than as specifically described.

What is claimed is:

1. An elevator rail for an elevator system attached to the outside of a building comprising, an H shaped rail with a first face with an outside surface facing away from the building, a second face with an outside surface facing the building and a cross portion between the first and the second face, a channel in the first face outside surface forming at least one trolley guide, at least one guide channel on the first face outside surface for guiding elevator wheels on the first face.

2. An elevator rail for an elevator system attached to the outside of a building as in claim 1 having, at least one light channel on the rail for providing lights.

3. An elevator rail for an elevator system attached to the outside of a building as in claim 1 having, expansion joints between sections of rail attached to the face of a building.

4. An elevator rail for an elevator system attached to the outside of a building as in claim 1 having, a rough surface on the rail for engaging tires of an elevator.

5. An elevator rail for an elevator system attached to the outside of a building as in claim 1 having, a rack in the at least one guide channel to engage a cog wheel on the elevator.

6. An elevator rail for an elevator system attached to the outside of a building as in claim 1 having, the cross portion with a smooth surface for engaging wheels on an elevator.

7. An elevator rail for an elevator system attached to the outside of a building as in claim 1 having, at least one trolley in the at least one trolley guide, the trolley for raising or lowering an elevator on the rail.

8. An elevator rail for an elevator system attached to the outside of a building as in claim 1 having, at least one light channel on the second surface for power cables.

* * * * *